US006056540A

United States Patent [19]

Newman et al.

[11] Patent Number: 6,056,540

[45] Date of Patent: May 2, 2000

[54] PILOT MOUNTING BRACKET INCLUDING HINGED PILOT SHIELD

[75] Inventors: James F. Newman; I. D. Burkholder, both of Harrisonburg, Va.

[73] Assignee: Shenandoah Manufacturing Co., Inc., Harrisonburg, Va.

[21] Appl. No.: 09/137,128

[22] Filed: Aug. 20, 1998

[51] Int. Cl.[7] ..... F23Q 3/00

[52] U.S. Cl. ..... 431/264; 431/266; 431/278; 126/39 E

[58] Field of Search ..... 126/39 R, 39 E, 126/85 A, 92 R, 92 B, 39 J; 431/258–266, 278; 119/306

[56] References Cited

U.S. PATENT DOCUMENTS

| | | | |
|---|---|---|---|
| 2,799,331 | 7/1957 | Hajny . | |
| 2,959,218 | 11/1960 | Hajny . | |
| 3,122,195 | 2/1964 | Kimmel et al. . | |
| 3,178,140 | 4/1965 | Kuhn et al. . | |
| 3,563,206 | 2/1971 | Hermann . | |
| 3,692,016 | 9/1972 | Stikkers | 431/278 |
| 3,992,137 | 11/1976 | Streisel . | |
| 4,298,336 | 11/1981 | Riehl | 431/264 |
| 4,381,758 | 5/1983 | Svekis et al. . | |
| 4,719,874 | 1/1988 | Maurice | 126/39 E |
| 4,919,084 | 4/1990 | Maurice | 119/306 |

FOREIGN PATENT DOCUMENTS

| | | | |
|---|---|---|---|
| 1199169 | 12/1959 | France | 431/278 |

OTHER PUBLICATIONS

Big Dutchman, SOLaire Infrared Radiant Brooder (brochure), Jan., 1997.

*Primary Examiner*—James C. Yeung
*Attorney, Agent, or Firm*—Nixon & Vanderhye P.C.

[57] ABSTRACT

A pilot and thermocouple mounting bracket for supporting a thermocouple and for supporting a pilot and pilot shield adjacent a burner includes a central plate member and a plurality of tabs attached to the central plate member. At least some of the tabs include apertures for receiving the thermocouple and the pilot and are bent in various configurations enabling the pilot to be supported in a substantially horizontal orientation relative to the burner. A locking tab forms part of the mounting bracket and is engageable with the pilot shield to eliminate the possibility of misplacing the pilot shield. By supporting the pilot in a substantially horizontal orientation relative to the burner, dust is prevented from building up in and around the pilot shield, and cleaning and lighting the pilot is made easier.

20 Claims, 5 Drawing Sheets

PILOT MOUNTING BRACKET INCLUDING HINGED PILOT SHIELD

BACKGROUND OF THE INVENTION

The present invention relates to a mounting bracket supporting a thermocouple and supporting a pilot and pilot shield adjacent a burner and, more particularly, to a pilot and thermocouple mounting bracket including a hinged pilot shield via a locking tab and structure supporting the pilot in a substantially horizontal orientation relative to the burner.

In a poultry house, it is important to provide growing birds with the freedom to choose the most comfortable warmth at any one moment. Optimal micro-climates can be created and controlled using radiant heating systems such as a radiant heat brooder. A poultry house environment, however, is a high-dust environment that can adversely affect the operation and functionality of the radiant heating systems. In particular, dust, fogging and other contaminants in the operational environment can build up and contaminate the pilot orifice when the pilot is not in operation, which is most of the time.

FIG. 5A illustrates an example of a conventional burner assembly for a radiant heat brooder. The conventional assembly 100 includes a circular burner disk 102 and a centrally disposed burner 104. A pilot and pilot shield assembly 106 is supported in a vertical orientation adjacent the burner 104 along with a thermocouple. The fuel source 108 for the pilot 106 is coupled with the pilot 106 through the burner disk 102. The assembly 100 also includes a fuel source 110 for the burner 104.

With this configuration, because of the vertical orientation of the pilot and pilot shield assembly 106, dust has a tendency to build-up in and around the pilot and pilot shield assembly 106. Moreover, the vertically orientated pilot is difficult to light as well as clean. During operation, it is necessary to curl the flame as shown so that the pilot will light properly and the thermocouple will stay hot. This curling is achieved by configuring the pilot shield, which thus increases manufacturing costs and time. Still further, because the pilot shield itself is not positively secured to the assembly, it is susceptible to being misplaced.

SUMMARY OF THE INVENTION

It is therefore an object of the invention to provide a pilot and thermocouple mounting bracket and a pilot and thermocouple assembly that overcomes the drawbacks in the conventional structure. It is another object of the invention to provide a mounting bracket and assembly including structure for supporting the pilot in a substantially horizontal orientation relative to the burner and structure for securing the pilot shield.

These and other objects of the invention are achieved by providing a mounting bracket including a central plate member and a plurality of tabs attached to the central plate member. At least some of the tabs include apertures for receiving the thermocouple and the pilot and are bent in various configurations enabling the pilot to be supported in a substantially horizontal orientation relative to the burner. A first one of a plurality of tabs may include a locking tab engageable with the pilot shield. One of the apertures may include a pilot aperture that is positioned to receive the horizontally oriented pilot, wherein the above-noted locking tab is disposed adjacent the pilot aperture.

A second one of the plurality of tabs preferably includes a primary support tab having a first section adapted to support the horizontally oriented pilot and a second section adapted to support at least part of the thermocouple. The locking tab is attached to the first section of the primary support tab and includes an arm extending from the first section and a locking panel engageable with an aperture in the pilot shield. In this context, the locking panel is wider than a width of the pilot shield aperture.

A third one of the plurality of tabs preferably includes a thermocouple tab disposed spaced from the primary support tab. The thermocouple tab is positioned relative to the second section of the primary support tab to cooperatively support the thermocouple.

A fourth one of the plurality of tabs includes a burner attachment tab attached to the central plate member at an opposite end thereof from the primary support tab. The burner attachment tab is engageable with a burner disk.

The central plate defines a reference plane, wherein the primary support tab and the thermocouple tab extend substantially perpendicular to the reference plane, and the locking tab and the burner attachment tab extend substantially parallel to the reference plane. The second section of the primary support tab and the thermocouple tab extend in substantially parallel planes that are skewed from the first section of the primary support tab.

In accordance with another aspect of the invention, there is provided a blank for forming a pilot and thermocouple mounting bracket. The blank includes a plurality of tabs attached to a central plate member and a plurality of apertures for receiving the thermocouple and the pilot. The tabs are bendable in various configurations enabling the pilot to be supported in a substantially horizontal orientation relative to the burner.

In accordance with yet another aspect of the invention, there is provided a pilot and thermocouple assembly attachable adjacent a burner. The assembly includes a mounting bracket including a central plate member and a plurality of tabs attached to the central plate member, wherein at least some of the plurality of tabs include apertures. The assembly also includes a thermocouple supported in at least one of the apertures and a pilot assembly including a pilot supported in others of the apertures. The plurality of tabs are bent in various configurations such that the pilot is supported in a substantially horizontal orientation relative to the burner.

In accordance with still another aspect of the invention, there is provided a pilot and thermocouple mounting bracket for supporting a pilot assembly including a pilot shield. The bracket includes a central plate member and at least one tab attached to the central plate member and engageable with the pilot shield.

With this structure, the pilot orifice is mounted in a substantially horizontal orientation, and dust cannot clog up the orifice. Notwithstanding, the horizontal orientation facilitates cleaning while reducing any accumulation of particles on or in the vicinity of the pilot orifice. During operation, the flame need not be curled as the configuration enables a direct flame to light the burner and the pilot. Moreover, the pilot shield is attached to the bracket via a locking tab engaging a slot or aperture in the pilot shield. Consequently, the pilot shield is prevented from becoming misplaced.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
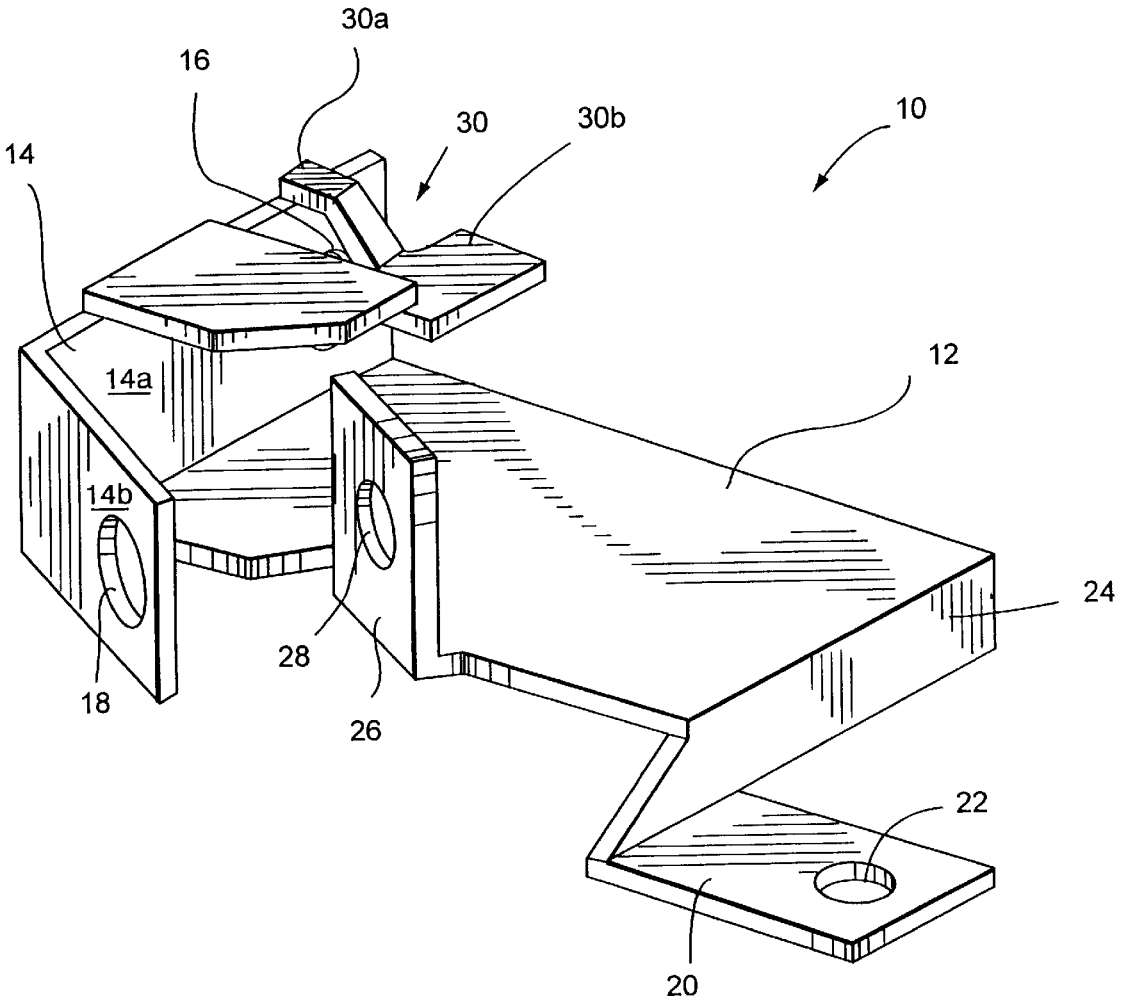
FIG. 1 is a perspective view of the pilot and the thermocouple mounting bracket according to the present invention.

FIG. 1 is a perspective view of the pilot and thermocouple mounting bracket according to the present invention. The bracket 10 generally includes a central plate member 12 and a plurality of tabs, some of which include apertures for receiving the components of the pilot and thermocouple assembly.

A primary support tab 14 includes a first section 14*a* and a second section 14*b*, which is bent at an angle relative to the first section 14*a*. The first section 14*a* of the primary support tab 14 includes a pilot aperture 16 for receiving the pilot, and the second section 14*b* of the primary support tab 14 includes an aperture 18 for supporting at least part of the thermocouple.

Figure 5A:
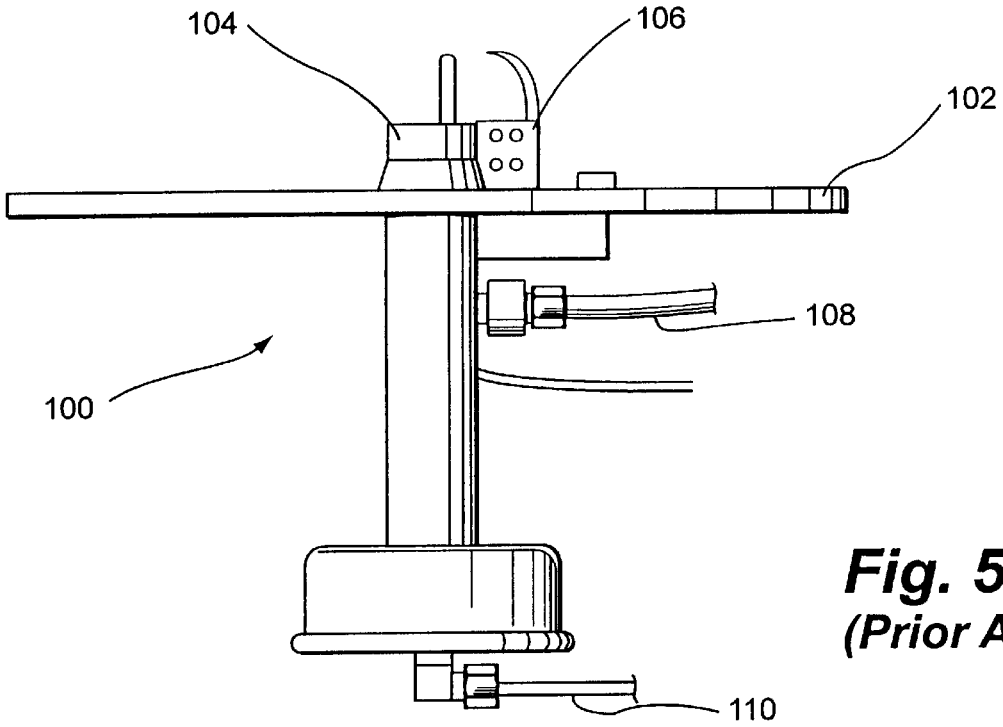
Fig. 5A (Prior Art)
FIG. 5A illustrates a conventional burner assembly configuration.
Figure 5B:
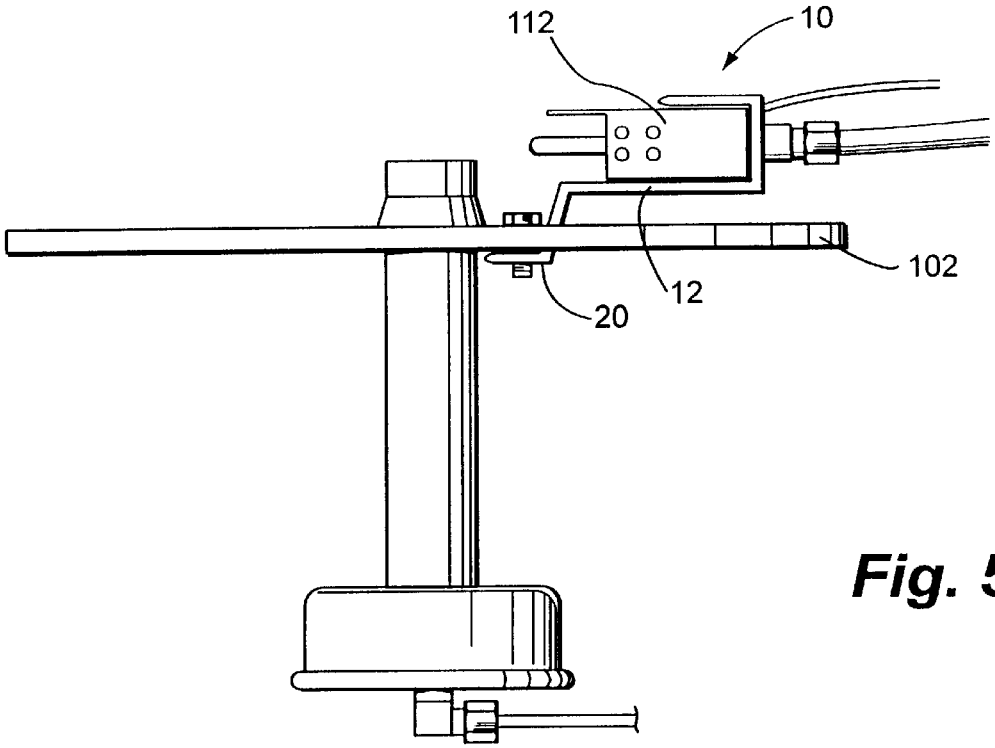
FIG. 5B illustrates a burner assembly incorporating the pilot and thermocouple mounting bracket according to the invention.

At an opposite end of the central plate member 12 from the primary support tab 14 is a burner attachment tab 20 including an aperture 22. The burner attachment tab 20 is disposed substantially parallel to the central plate member 12 and is spaced from the central plate member via a spacing hinge 24. The hinge 24 is bent in a downward orientation such that when the mounting bracket is secured to the burner disk 102, the hinge 24 extends through the burner disk 102, and the burner attachment tab 20 is secured to an underside of the burner disk 102 (see FIG. 5B). With this structure, the central plate 12 is disposed substantially parallel to the burner disk 102 and spaced above the burner disk 102 as shown in FIG. 5B. In this arrangement, the bracket 10 is removable from the burner disk via a threaded connector or the like. In an alternative arrangement, the bracket 10 may be welded or otherwise fixed to the burner disk 102.

A thermocouple tab 26 including an aperture 28 is disposed spaced from the primary support tab 14 at a position relative to the second section 14*b* of the primary support tab 14 to cooperatively support the thermocouple. That is, as assembled, the thermocouple extends through the aperture 18 in the second section 14*b* of the primary support tab 14 and the aperture 28 in the thermocouple tab 26. The tip of the theromocouple is preferably located in the gas flow path of the pilot orifice, i.e., essentially in line (intersects) with a longitudinal axis A defined by the pilot. In operation, the thermocouple creates a millivolt signal responsive to temperature.

As noted, the central plate member 12 is disposed substantially parallel to the burner disk 102 by virtue of the hinge 24 and the burner attachment tab 20. Relative to a reference plane defined by the central plate member 12, the primary support tab 14 and the thermocouple tab 26 extend substantially perpendicular to the reference plane. With this structure, the pilot can be supported by the aperture 16 in the first section 14*a* of the primary support tab 14 in a substantially horizontal orientation relative to the burner as shown in FIG. 5B. The thermocouple is also supported in a substantially horizontal orientation by the apertures 18 and 28. The second section 14*b* of the primary support tab 14 and the thermocouple tab 28, however, extend in substantially parallel planes that are skewed from the first section of the primary support tab as shown in FIG. 1.

The horizontal orientation of the pilot makes it easier to clean. The horizontal orientation also reduces any accumulation of particles on or in the vicinity of the pilot orifice.

Figure 3:
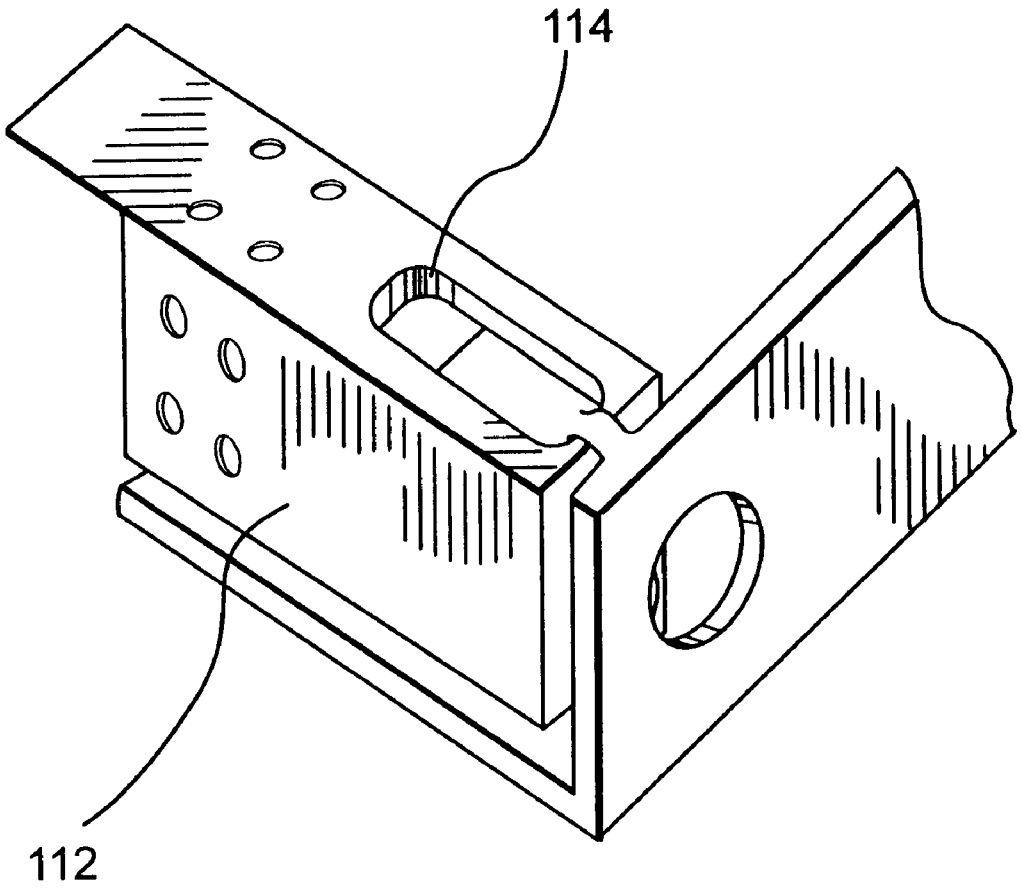
FIG. 3 is a perspective view of the pilot shield engaging the locking tab of the pilot and thermocouple mounting bracket.
Figure 4:
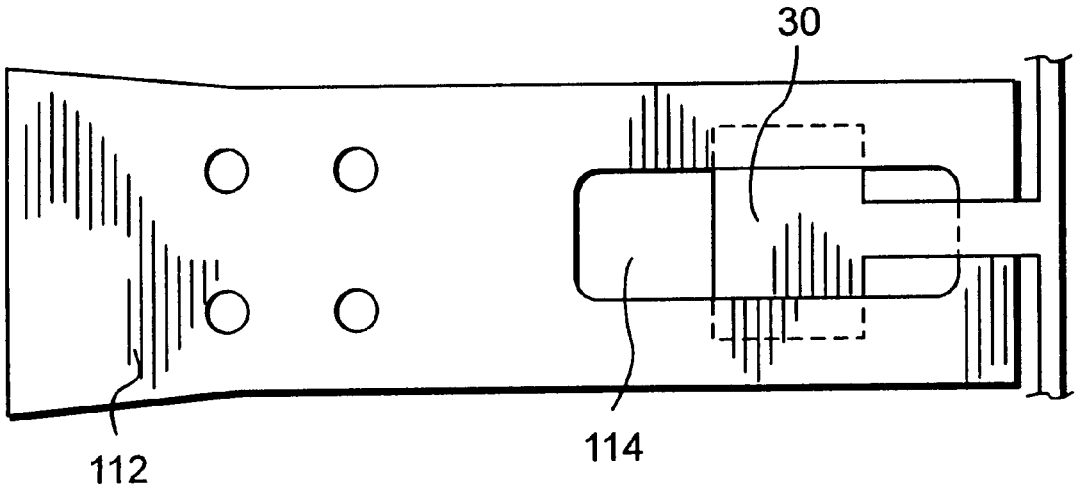
FIG. 4 is a plan view of the pilot shield illustrated in FIG. 3 engaging the locking tab.

With continued reference to FIG. 1, the bracket 10 is also provided with a locking tab 30 including an arm 30*a* extending from the first section 14*a* of the primary support tab 14 and a locking panel 30*b* at an opposite end of the arm 30*a*. The locking tab 30 is disposed adjacent the pilot aperture 16 and is engageable with an aperture in the pilot shield 112. As shown in FIGS. 3 and 4, the pilot shield 112 includes an aperture 114 having a width that is narrower than the width of the locking panel 30*b* of the locking tab 30. By virtue of the length of the aperture 114, as well as the size of the arm 30*a* of the locking tab 30, the pilot shield 112 can be maneuvered to the secured position illustrated in FIGS. 3 and 4. Moreover, gravity tends to move the pilot shield back into the operational position. Once positioned, the pilot shield is prevented from being separated from the assembly while enabling free manual movement of the pilot shield 112. The hinged shield can thus be moved to clean the pilot orifice if it becomes contaminated.

Figure 2:
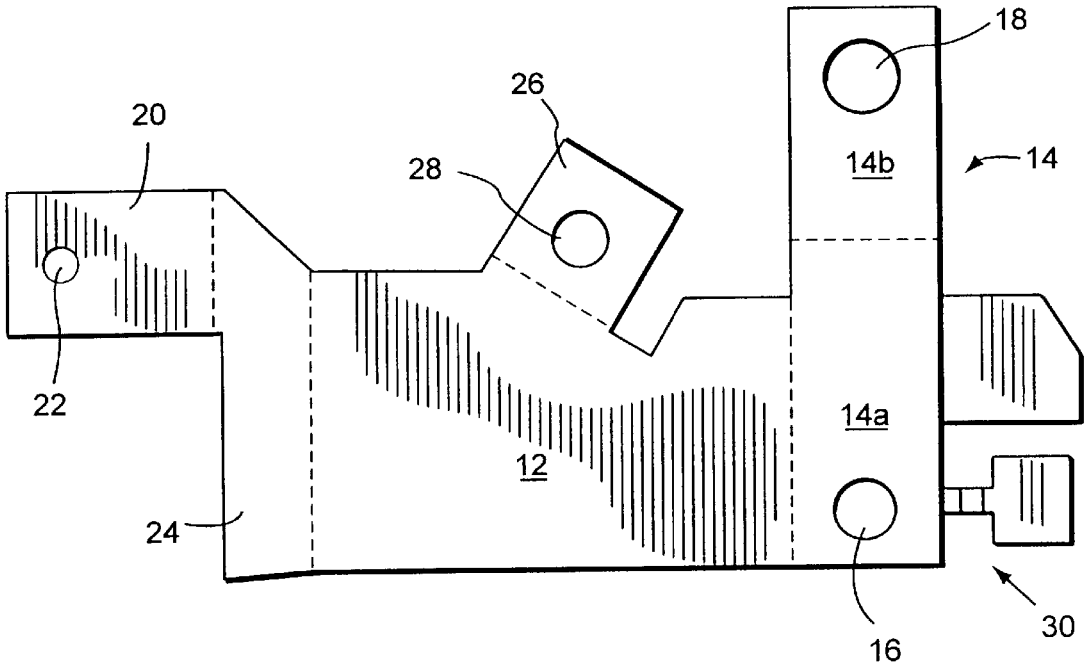
FIG. 2 is a plan view of the blank for forming the pilot and thermocouple mounting bracket.

FIG. 2 illustrates a blank for forming the pilot and thermocouple mounting bracket according to the present invention. The blank is preferably formed by stamping from a sheet of material and includes the plurality of tabs discussed above attached to the central plate member 12. The tabs are bendable in various configurations as illustrated in FIG. 1 for supporting the thermocouple and the pilot and pilot shield assembly and further enabling the pilot to be supported in a substantially horizontal orientation relative to the burner. As shown, the locking tab 30 is attached to the primary support tab 14.

By virtue of the structure according to the present invention, a pilot and thermocouple mounting bracket can be provided that supports the pilot in a substantially horizontal orientation relative to the burner. With this arrangement, dust is prevented from building up in and around the pilot shield, and cleaning and lighting of the pilot is made easier. Moreover, by providing a locking tab for the pilot shield, the possibility of misplacing the pilot shield is eliminated.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A pilot and thermocouple mounting bracket for supporting a thermocouple and for supporting a pilot assembly including a pilot adjacent a burner, the mounting bracket comprising:

a central plate member; and a plurality of tabs attached to the central plate member, at least some of the plurality of tabs including apertures for receiving the thermocouple and the pilot and being bent in various configurations enabling the pilot to be supported in a substantially horizontal orientation relative to the burner, wherein the pilot assembly includes a pilot shield and wherein a first one of the plurality of tabs comprises a locking tab engageable with the pilot shield, the locking tab including an arm extending from the central plate member and a locking panel engageable with an aperture in the pilot shield.

2. A pilot and thermocouple mounting bracket according to claim 1, wherein one of the apertures comprises a pilot aperture that is positioned to receive the horizontally oriented pilot, the locking tab being disposed adjacent the pilot aperture.

3. A pilot and thermocouple mounting bracket according to claim 1, wherein a second one of the plurality of tabs comprises a primary support tab having a first section adapted to support the horizontally oriented pilot and a second section adapted to support at least part of the thermocouple, the locking tab being attached to the first section of the primary support tab, wherein the locking panel is wider than a width of the pilot shield aperture.

4. A pilot and thermocouple mounting bracket according to claim 3, wherein a third one of the plurality of tabs comprises a thermocouple tab disposed spaced from the primary support tab, the thermocouple tab being positioned relative to the second section of the primary support tab to cooperatively support the thermocouple.

5. A pilot and thermocouple mounting bracket according to claim 4, wherein a fourth one of the plurality of tabs comprises a burner attachment tab attached to the central plate member at an opposite end thereof from the primary support tab, the burner attachment tab being engageable with a burner disk.

6. A pilot and thermocouple mounting bracket according to claim 5, wherein the central plate defines a reference plane, the primary tab and the thermocouple tab extending substantially perpendicular to the reference plane and the locking tab and the burner attachment tab extending substantially parallel to the reference plane.

7. A pilot and thermocouple mounting bracket according to claim 6, wherein the second section of the primary support tab and the thermocouple tab extend in substantially parallel planes that are skewed from the first section of the primary support tab.

8. A pilot and thermocouple mounting bracket according to claim 1, wherein another one of the plurality of tabs comprises a burner attachment tab attached to the central plate, the burner attachment tab being engageable with a burner disk.

9. A blank for forming a pilot and thermocouple mounting bracket that supports a thermocouple and supports a pilot assembly including a pilot adjacent a burner, the blank comprising:

a plurality of tabs attached to a central plate member;

a plurality of apertures for receiving the thermocouple and the pilot, wherein the tabs are bendable in various configurations enabling the pilot to be supported in a substantially horizontal orientation relative to the burner; and a locking tab attached to one of the plurality of tabs, the locking tab being engageable with the pilot shield, wherein the locking tab includes an arm extending from the central plate member and a locking panel engageable with an aperture in the pilot shield.

10. A blank according to claim 9, wherein one of the plurality of tabs comprises a primary support tab having a first section adapted to support the horizontally oriented pilot and a second section adapted to support at least part of the thermocouple, and wherein the locking panel is wider than a width of the pilot shield aperture.

11. A pilot and thermocouple assembly attachable adjacent a burner, the assembly comprising:

a mounting bracket including a central plate member and a plurality of tabs attached to the central plate member, at least some of the plurality of tabs including apertures;

a thermocouple supported in at least one of the apertures; and a pilot assembly including a pilot supported in others of the apertures, wherein the plurality of tabs are bent in various configurations such that the pilot is supported in a substantially horizontal orientation relative to the burner, wherein the pilot assembly comprises a pilot shield, the pilot and thermocouple assembly further comprising a locking tab attached to one of the plurality of tabs, the locking tab releasably engaging the pilot shield and including an arm extending from the central plate member and including a locking panel engageable with an aperture in the pilot shield.

12. A pilot and thermocouple assembly according to claim 11, wherein one of the apertures comprises a pilot aperture receiving the horizontally oriented pilot, the locking tab being disposed adjacent the pilot aperture.

13. A pilot and thermocouple assembly according to claim 11, wherein a second one of the plurality of tabs comprises a primary support tab having a first section supporting the horizontally oriented pilot and a second section supporting at least part of the thermocouple, wherein the locking panel is wider than a width of the pilot shield aperture.

14. A pilot and thermocouple assembly according to claim 13, wherein a third one of the plurality of tabs comprises a thermocouple tab disposed spaced from the primary support tab, the thermocouple tab being positioned relative to the second section of the primary support tab to cooperatively support the thermocouple.

15. A pilot and thermocouple assembly according to claim 14, wherein a fourth one of the plurality of tabs comprises a burner attachment tab attached to the central plate member at an opposite end thereof from the primary support tab, the burner attachment tab being engageable with a burner disk.

16. A pilot and thermocouple assembly according to claim 15, wherein the central plate defines a reference plane, the primary tab and the thermocouple tab extending substantially perpendicular to the reference plane and the locking tab and the burner attachment tab extending substantially parallel to the reference plane.

17. A pilot and thermocouple assembly according to claim 16, wherein the second section of the primary support tab and the thermocouple tab extend in substantially parallel planes that are skewed from the first section of the primary support tab.

18. A pilot and thermocouple assembly according to claim 11, wherein the thermocouple creates a millivolt signal responsive to temperature, and wherein the tip is positioned intersecting a longitudinal axis defined by the pilot.

19. A pilot and thermocouple mounting bracket for supporting a pilot assembly including a pilot shield, the mounting bracket comprising a central plate member and at least one tab attached to the central plate member and engageable with the pilot shield, wherein the tab comprises an arm extending from the central plate member and a locking panel engageable with an aperture in the pilot shield.

20. A pilot and thermocouple assembly according to claim 19, wherein the locking panel is wider than a width of the pilot shield aperture.

* * * * *